US007900408B2

(12) United States Patent
Holland et al.

(10) Patent No.: US 7,900,408 B2
(45) Date of Patent: Mar. 8, 2011

(54) STORM PANEL FOR PROTECTING WINDOWS AND DOORS DURING HIGH WINDS

(75) Inventors: John E. Holland, Bailey, NC (US); Connie W. Holland, Bailey, NC (US); Daniel M. Nathan, Wendell, NC (US)

(73) Assignee: JHRG, LLC, Spring Hope, NC (US)

( * ) Notice: Subject to any disclaimer, the term of this patent is extended or adjusted under 35 U.S.C. 154(b) by 140 days.

(21) Appl. No.: 11/767,753

(22) Filed: Jun. 25, 2007

(65) Prior Publication Data

US 2008/0313978 A1 Dec. 25, 2008

(51) Int. Cl.

| | |
|---|---|
| ***A47G 5/02*** | (2006.01) |
| ***E06B 9/08*** | (2006.01) |
| ***E06B 3/30*** | (2006.01) |
| *A47H 1/00* | (2006.01) |

(52) U.S. Cl. ..... 52/202; 160/368.1

(58) Field of Classification Search ..... 52/202, 52/203, 506.01, 222; 135/90, 123, 903; 160/DIG. 19, 133, 238, 264, 368.1

See application file for complete search history.

(56) References Cited

U.S. PATENT DOCUMENTS

| | | | | | |
|---|---|---|---|---|---|
| 341,112 | A | * | 5/1886 | Teufel | 52/202 |
| 1,977,165 | A | * | 10/1934 | Williams | 160/354 |
| 3,715,843 | A | | 2/1973 | Ballinger | |
| 3,805,816 | A | | 4/1974 | Nolte | |
| 3,862,876 | A | | 1/1975 | Graves | |
| 3,949,527 | A | | 4/1976 | Double et al. | |
| 4,131,150 | A | | 12/1978 | Papadakis | |
| 4,189,880 | A | | 2/1980 | Ballin | |
| 4,210,191 | A | | 7/1980 | Li | |
| 4,283,888 | A | | 8/1981 | Cros | |
| 4,356,138 | A | | 10/1982 | Kavesh et al. | |
| 4,397,122 | A | | 8/1983 | Cros | |
| 4,413,110 | A | | 11/1983 | Kavesh et al. | |
| 4,457,985 | A | | 7/1984 | Harpell et al. | |
| 4,590,714 | A | | 5/1986 | Walker | |
| 4,764,142 | A | * | 8/1988 | Griffith et al. | 135/90 |
| 4,815,562 | A | | 3/1989 | Denny et al. | |
| 4,858,395 | A | * | 8/1989 | McQuirk | 52/3 |
| 4,932,457 | A | | 6/1990 | Duncan | |
| 5,082,721 | A | * | 1/1992 | Smith et al. | 442/289 |
| 5,319,967 | A | * | 6/1994 | Rickards, Jr. | 73/170.06 |
| 5,347,768 | A | | 9/1994 | Pineda | |
| 5,522,184 | A | | 6/1996 | Oviedo-Reyes | |
| 5,540,177 | A | | 7/1996 | Masters | |
| 5,555,681 | A | * | 9/1996 | Cawthon | 52/63 |
| 5,722,206 | A | * | 3/1998 | McDonald | 52/202 |
| 5,752,557 | A | * | 5/1998 | Crider et al. | 160/121.1 |
| 5,791,090 | A | | 8/1998 | Gitlin et al. | |

(Continued)

OTHER PUBLICATIONS

Letter (including 5 exhibits) dated Apr. 8, 2010 addressed to Robert Rhodes from Michael Murray.

*Primary Examiner* — David Dunn
*Assistant Examiner* — Joseph J Sadlon
(74) *Attorney, Agent, or Firm* — Womble Carlyle Sandridge & Rice, PLLC

(57) ABSTRACT

A storm panel of high strength fabric is constructed, reinforced, and installed in such a way as to comply with the building codes as a large missile impact system. When not in use, the fabric can be rolled and stored and placed in an attractive cover without disassembly.

5 Claims, 8 Drawing Sheets

U.S. PATENT DOCUMENTS 5,915,449 A 6/1999 Schwartz
6,057,029 A 5/2000 Demestre et al.
6,125,905 A 10/2000 Woodside et al.
6,176,050 B1 1/2001 Gower
6,263,949 B1 7/2001 Guthrie, Jr.
6,280,546 B1 8/2001 Holland et al.
6,286,579 B1 9/2001 Gottschalk
6,296,039 B1 10/2001 Mullet et al.
6,325,085 B1 12/2001 Gower
6,341,455 B1 * 1/2002 Gunn ..... 52/202
6,412,540 B2 7/2002 Hendee
6,532,702 B1 * 3/2003 Scribner ..... 52/202
6,550,191 B2 * 4/2003 Hoffmann et al. ..... 52/173.2
6,615,555 B2 9/2003 Madden
6,755,232 B1 * 6/2004 Holland et al. ..... 160/368.1
6,818,091 B1 11/2004 Holland et al.
6,851,464 B2 2/2005 Hudoba et al.
6,865,852 B2 3/2005 Gower
6,886,299 B2 5/2005 Gower
6,886,300 B2 5/2005 Hudoba et al.
6,898,907 B2 5/2005 Diamond
6,959,748 B2 11/2005 Hudoba
7,080,490 B2 * 7/2006 Horn et al. ..... 52/309.7
7,325,365 B2 * 2/2008 Warner ..... 52/203
2003/0079430 A1 5/2003 Hanks
2003/0159372 A1 8/2003 Motro
2003/0159373 A1 8/2003 Lien
2004/0010988 A1 1/2004 Jaycox et al.
2004/0035082 A1 2/2004 Hudoba et al.
2004/0144498 A1 7/2004 Hudoba et al.
2004/0154242 A1 * 8/2004 Hudoba et al. ..... 52/202
2004/0221534 A1 11/2004 Hanks
2005/0210749 A1 * 9/2005 DuBose et al. ..... 49/118
2005/0279465 A1 12/2005 Gower
2006/0151132 A1 7/2006 Scalfani et al.
2007/0044399 A1 * 3/2007 Palko ..... 52/202
2007/0227083 A1 * 10/2007 Skobba ..... 52/202
2008/0000056 A1 1/2008 Murray
2008/0040994 A1 * 2/2008 Borland ..... 52/202

* cited by examiner

STORM PANEL FOR PROTECTING WINDOWS AND DOORS DURING HIGH WINDS

BACKGROUND OF THE INVENTION

1. Field of the Invention

This invention relates to a storm panel to protect property against damage caused by high winds and impact from associated flying objects and debris that result from a hurricane or other occurrence.

2. Description of the Related Art

Various devices and materials have been proposed for the protection of building openings (such as windows, doors, and sliding glass doors) from the effects of high winds and flying objects associated with a hurricane or similar event. Some have even been utilized. In the simplest and most often utilized form, sheets of plywood have been nailed, screwed, or otherwise attached to a building as a covering for windows and doors. The user needs to acquire and cut plywood sheets to the proper dimensions to cover the openings and to install them. Because of their appearance, bulkiness and weight, plywood covers are typically installed only when a hurricane or similar incident is imminent. During the hurricane or other storm, the plywood prevents any light from entering into the building and electricity frequently gets interrupted during hurricanes. As a result, the covered windows and doors produce a cave-like effect that is uncomfortable and inconvenient to the building occupants. After the threat of damage has passed, the plywood sheets must be removed by hand. The securing system (nails, etc.) may cause damage to the building structure.

Another protective system is a plurality of corrugated steel, aluminum or other metal panels. These panels usually have holes provided in several locations along their periphery and are adapted to be positioned on anchor screws that have been secured to the building around the opening to be protected. Wing nuts are typically used to secure the metal panels to the screws and the panels are held in place by a combination of the screw-wing nut assembly and rails that at least partially surround the windows and doors. Like plywood, these panels are usually very heavy. They also need to be installed before a hurricane event and removed afterwards. Also, like the plywood system, these metal panels or "shutters" block out most of the outside light when they are installed in place. In addition, they must be stored in a place which prevents the panels from being readily obtained when needed. Thus, the metal shutters provide an unsightly and inconvenient, although effective, protection against the effects of a hurricane.

One system that provides light into a building while providing protection against hurricanes, uses heavy plastic, translucent, corrugated sheets, such as those formed of polycarbonate. These sheets are typically installed in a manner similar to the metal panels. They are also unsightly, heavy and cumbersome to install, must be removed, and require significant storage space. Combinations of metal and plastic panels have also been suggested in U.S. Pat. No. 6,615,555.

Another type of protective device is a flexible metal shutter that is formed from interconnected metal slats. These shutters may be manually or electrically operated and are permanent attachments to the building. They are adapted to be rolled up or opened laterally in an accordion-like manner. Although the structures offer acceptable protection, they likewise prevent very little light to penetrate when they are in their protective position. These systems also tend to be the most expensive. Since they are permanently installed they can detract from the aesthetics of the home.

Still another protective system is a coated fabric made from a plastic coated polyester material. The coated fabric is typically very thick to provide protection against wind and flying object damage. The fabric is also provided with grommets along its periphery. The coated polyester fabric is secured to the building usually with anchor screws that are attached to the building with wing nut fasteners. These fabrics are heavy and difficult to install, and are relatively bulky to store. They do not allow sufficient light to enter the building, after they are installed their strength and ability to protect are questionable and do not meet new codes, and they must be removed and stored when not in use.

Other fabric protective systems are disclosed, for example, in U.S. Pat. Nos. 6,176,050; 6,263,949; 6,341,455; 6,851,464, and 6,886,300, as well as in the following U.S. Published Applications Nos. 2003/0079430; 2004/0154242; and 2004/0221534.

SUMMARY OF THE INVENTION

Thus, despite the existence of such storms for many, many years, and despite the existence of materials of many types, including high strength fabrics, no satisfactory solution has been found. Now surprisingly, a storm panel has been developed, that is lightweight, translucent, and, when constructed and installed in accordance with the teaching of the present invention, will effectively protect window and door openings from debris and airborne objects occurring during hurricane force winds, while allowing light into the building. "Effectively protect," as used herein, means the product of the invention will comply with the 2004 Florida Building Code and the 2003 International Building Code as a large missile impact system.

In accordance with one aspect of the invention, a high strength fabric panel, of such size and shape as to extend across a selected door or window opening is provided with a hem along the top and bottom edge. A strip of reinforcing material (aluminum and the like) is inserted in each hem and a series of holes is placed through both the hem and reinforcing strip at strategically spaced positions along the hem. When used with the appropriate anchor screws, there is provided a reinforced anchoring device that securely holds the fabric panel in place during a storm.

According to another aspect, there is provided a cover and c-shaped clips that cover the rolled up fabric panel and provide a system for attractively storing the panel adjacent the corresponding window or door when not in use.

According to yet another aspect, the fabric panel is formed of high strength yarns made from high strength, high tenacity (greater than 7 g/d) polymeric fibers, such as ultra high molecular weight polyethylene, ultra high molecular weight aramids, and ultra high molecular weight polypropylene.

Such a device, when properly installed with the reinforcing strips and anchored appropriately is able to protect the windows and doors once it is installed, from airborne debris and objects commonly associated with hurricanes.

BRIEF DESCRIPTION OF THE DRAWINGS

Having described the invention in general terms, reference will now be made to the accompanying drawings, which are not necessarily drawn to scale, and wherein.

DESCRIPTION OF ONE OR MORE OF PREFERRED EMBODIMENTS

Figure 1:
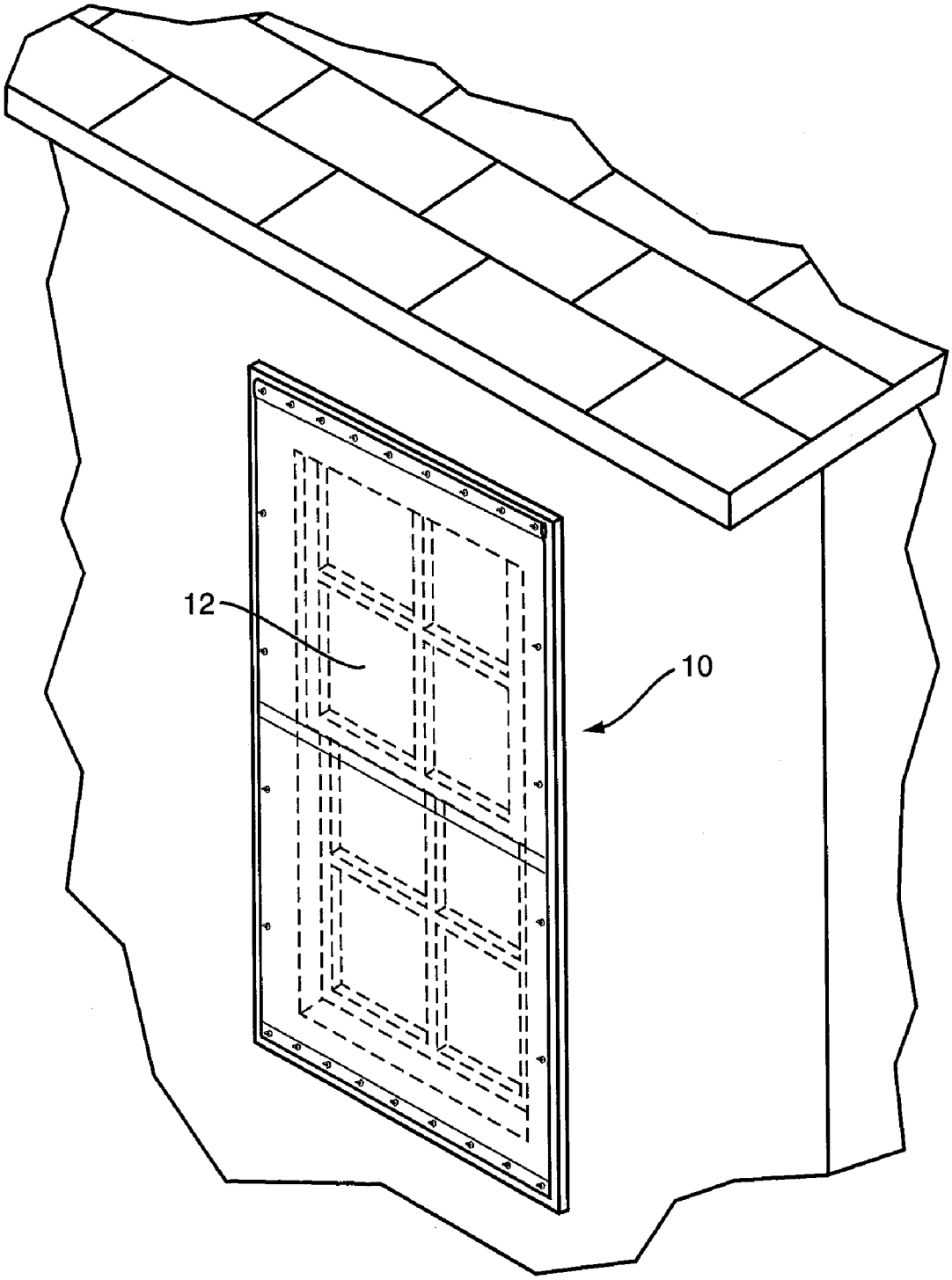
FIG. 1 is a perspective view of a window having installed thereon a storm panel of the present invention, shown rolled down in readiness for a storm.
Figure 2:
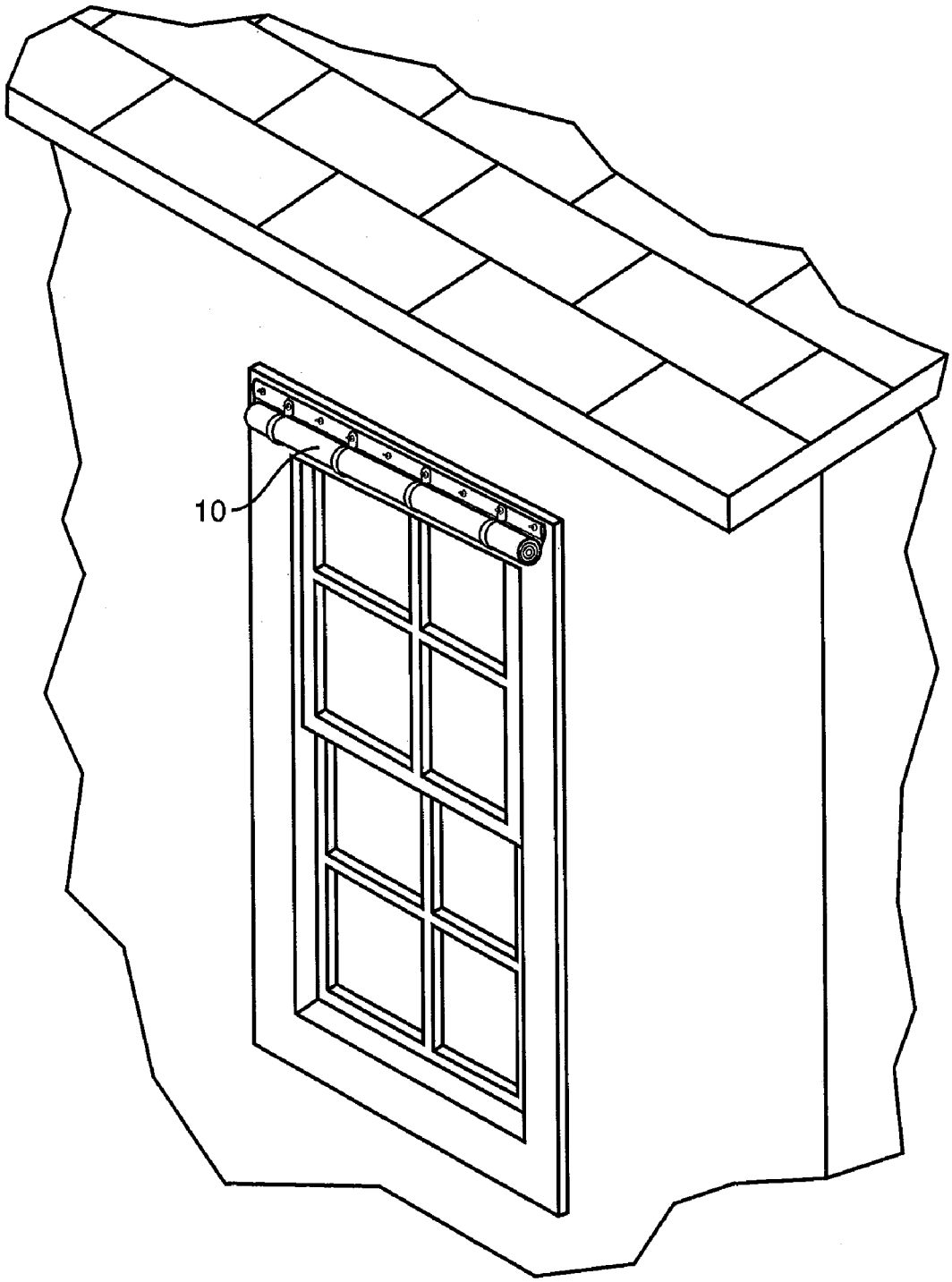
FIG. 2 is a perspective view similar to FIG. 1, except showing the panel in the rolled up, stored position.
Figure 3:
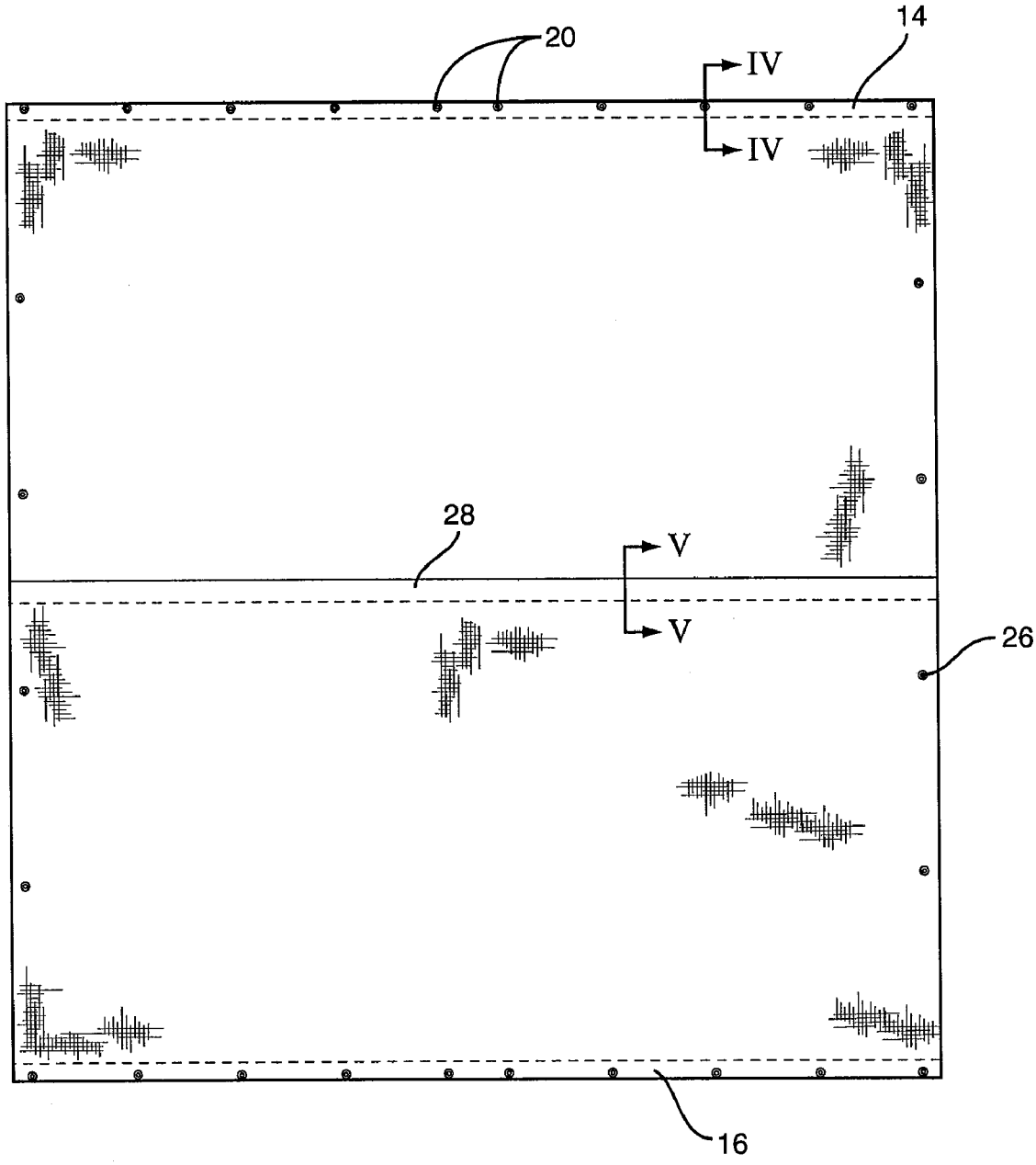
FIG. 3. is an elevation view of the panel without attaching hardware.

Turning now the drawings, a storm panel for windows, doors, sliding doors, and the like is illustrated in FIGS. 1-3. The storm panel is shown generally as reference 10 and is illustrated installed over a window of a house. The storm panels can be of various lengths and widths to cover various size openings, such as windows, double windows, doors, sliding doors, etc.

Figure 4:
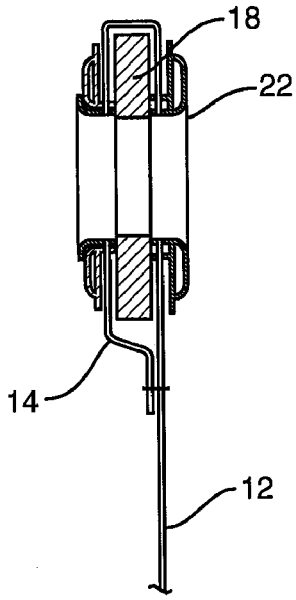
FIG. 4 is an enlarged sectional view taken substantially along lines 4-4 in FIG. 3 and illustrating the positioning of the reinforcing strip.

As best illustrated in FIG. 1, storm panel 10 includes a translucent fabric panel 12 formed of relatively high strength yarns, described below, having an upper and lower hem 14, 16. A flat reinforcing bar 18 in the form of an aluminum, or other metal, plastic, or other similar material strip is inserted in each hem 14, 16. The purpose of the strip is to reinforce the points of attachment, so that when extremely high winds are prevalent, excessive stress is taken off the fabric itself. A plurality of spaced openings 20 extend along the upper and lower hems through the fabric material and the reinforcing strips. The spaced openings or holes are placed apart a distance of from 4-12 inches, depending upon the anticipated forces that the panel is intended to withstand. Obviously, the closer the openings, the higher the wind force intended to be withstood. Grommets 22 (FIG. 4) are placed through the openings in the hems and strips.

The term "relatively high strength yarns" or "high strength fabric" as used herein, are yarns and/or fabrics sufficiently strong that, when constructed and attached as described herein, will pass the 2004 Florida Building Code and the 2003 International Building Code as a large missile impact system. Examples of high strength yarns and fabrics include those formed primarily of ultra high molecular weight polyethylene, ultra high molecular weight aramids, and ultra high molecular weight polypropylene, those formed of blends of such compositions. Aramids are intended to include para-aramids such as KEVLAR® by Dupont. The term "translucent" means the fabric transmits at least 60% of the light striking its surface.

Figure 5:
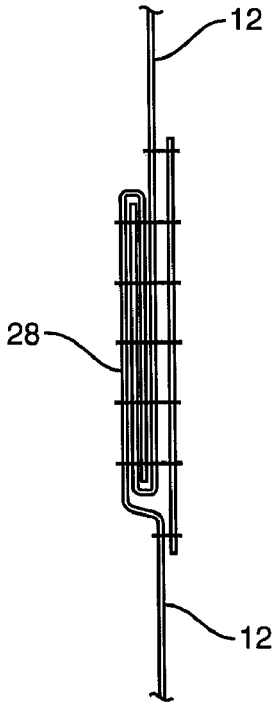
FIG. 5 is an enlarged sectional view taken substantially along lines 5-5 in FIG. 3 and illustrating a panel seam.

Optional aspects of the fabric panel 12 include additional side openings 26, so that the fabric panel can be fastened on the sides as well as at the top and bottom. Also, in the cases of a larger window opening, the fabric panel 12 may have to have a seam 28. The seam is better shown in FIG. 5.

Turning now to FIGS. 6A, 6B, 8A, and 8B, there is better illustrated the mounting system 30 that shows the manner in which the storm panel 10 is installed to the building. First, guide holes 31 are drilled in the framing, facing, or other area around the window opening to a depth of 1-2 inches depending upon the type of anchor screw used. Two types of anchor screws which will satisfactorily anchor the panel include the Tapcon SG 32 with washered wingnut 34 by ITW Buildex and the Sammy Super Screw 36 also by ITW Buildex, the difference being that the Tapcon SG 32 (illustrated in FIG. 6A) includes a threaded shaft extending outwardly of the structure, and a washered wingnut 34 is used to tighten down against the hem 14, 16. The Sammy Super Screw 36 (FIG. 8A) differs in that there is no wingnut, and the screw includes a stainless steel cap that overlies the hem and is inserted through the hem as the screw is attached. The Sammy Super Screw also includes an enlarged shoulder 37 (FIG. 8A) to provide reinforcement of the screw shank.

While the screw type anchors shown above are illustrative of the types of anchors that can be used, other types of anchoring means can also be used depending upon whether the structure is wood, concrete, concrete block, brick, stucco, etc., it being understood that the type of anchor should be selected depending upon the type material into which it must be inserted and secured. The process involves lining up the holes in the wall with the openings in the hem and reinforcing strip. The hole positions are marked on the wall, and then using a drill, drilling a hole into the wall an appropriate depth and diameter. The fabric panel 12 is then attached by securing the upper hem 14 to the portion of the wall above the wall opening, then securing the lower hem 16 to the area below the opening in the same manner. If the optional side openings are used, the sides are then secured in the same manner.

Figure 6A:
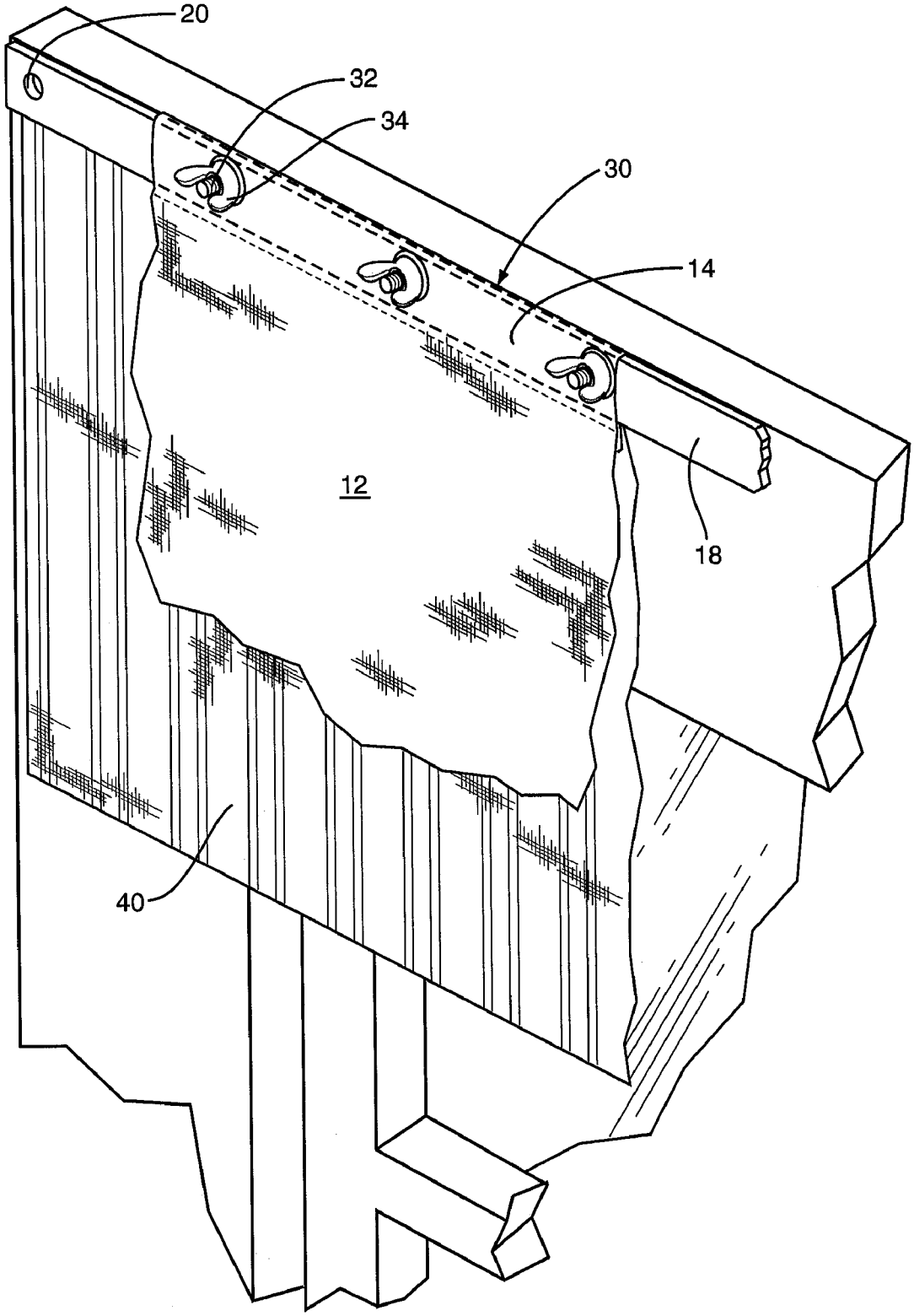
FIG. 6A is an enlarged partial perspective illustrating how the panel hem, connecting strip, and protective cover are attached to the face of a facing.
Figure 6B:
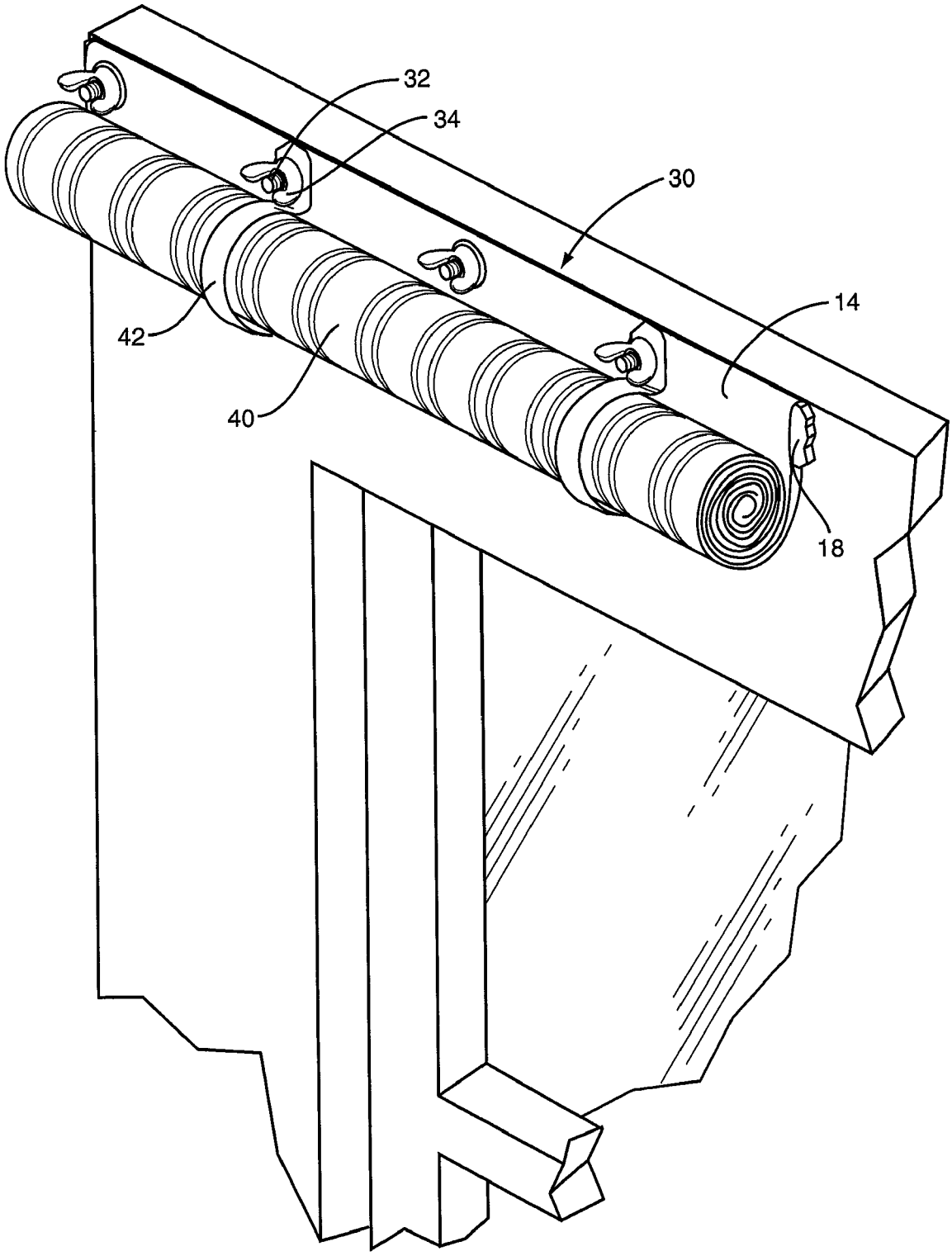
FIG. 6B is a view similar to FIG. 6A, except showing the panel rolled up and the cover and c-clip in place.
Figure 7A:
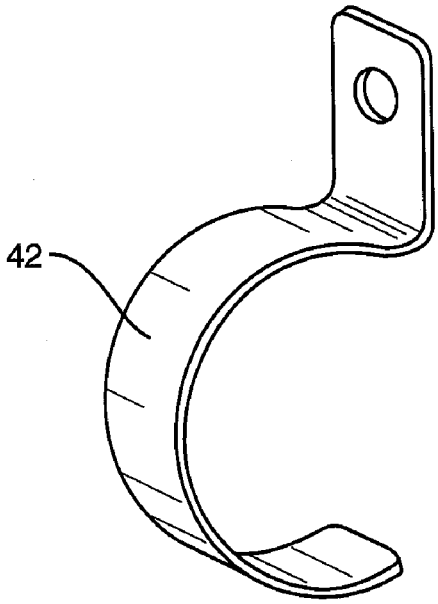
FIG. 7A is a perspective view of the c-clip alone removed from the storm panel.
Figure 7B:
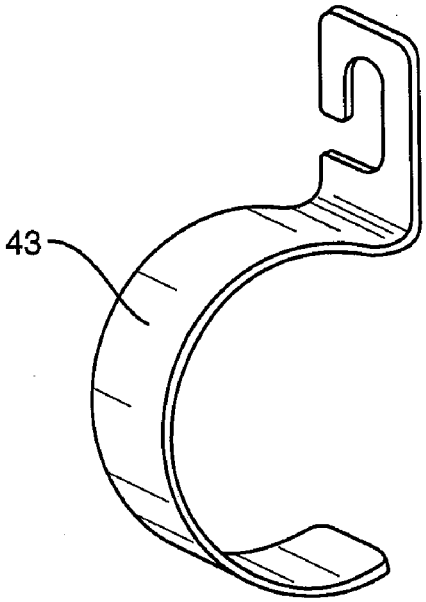
FIG. 7B is a perspective of an alternate form of the c-clip.

In FIG. 6B, there is illustrated one example of how the fabric panel 12 may be stored and placed in times when a storm is not imminent. To move the panel to the stored position above the window, the lower hem 14 and its reinforcing bar 18 are released from the lower side of the opening, rolled up, and then stored in its upper position by means of one or more c-clips 42 which are also attached to the anchor screws 32. Obviously, the c-clips 42 must be removed before emplacing the storm panel in its protective position, then replaced when the panel 12 is rolled up to its stored position. The same anchor screws 32 are used secure both the storm panel 12 and the c-clips. One type of c-clip 42 is illustrated in FIG. 7A. This type of c-clip requires the complete removal of the corresponding anchor screw 36 or wingnut 34 to emplace or remove the c-clip. Alternatively, a slotted c-clip 43 (FIG. 7B) may be used, which only requires a loosening of the anchor screw 36 or wing nut 34 for emplacement or removal.

An attractive protective cover 40 of some suitable material such as a solution dyed acrylic fabric such as SUNBRELLA® by Glen Raven may optionally be provided. The protective cover 40, as illustrated in FIGS. 6A and 6B is suitably attached adjacent to or around upper hem 14, and then folded around the storm panel in the rolled up position, whereupon the c-clips 42 maintain the cover and the rolled up fabric panel 12 in the stored position until the time arrives to install the panel in its protective position again.

While FIGS. 6A, 6B are illustrative of a system in which the cover 40 is behind the panel 12, and the panel 12 and cover 40 are rolled to the outside, the cover 40 could be placed on the outside and the panel 12 could be rolled in either direction.

Figure 8A:
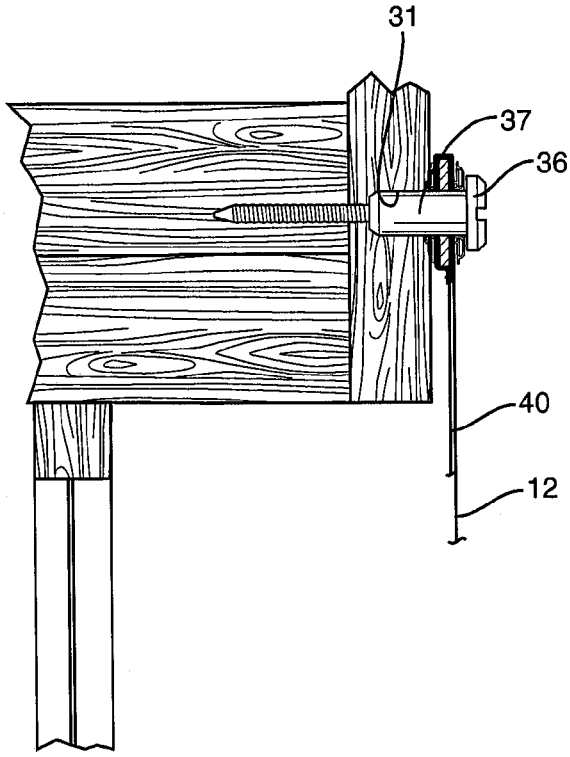
FIG. 8A is a cross-sectional view of a window frame with the storm panel attached illustrating how the anchor screws attach the storm shade to a window facing.
Figure 8B:
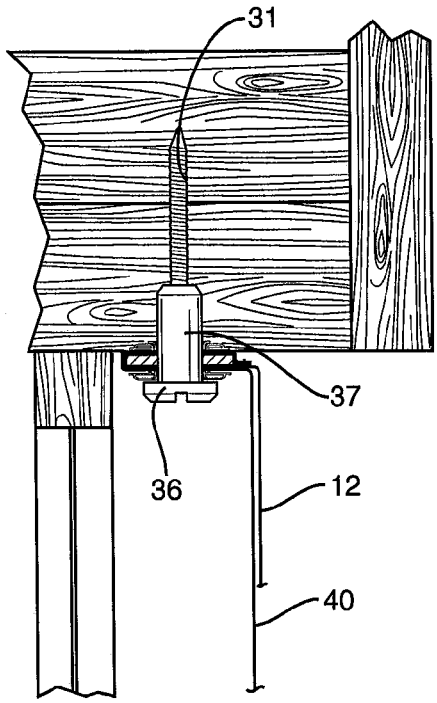
FIG. 8B is a view similar to FIG. 6, except showing the storm panel attached to the underside of a window facing.

FIGS. 8A and 8B illustrate how the panel is installed. The anchor screws 36 may be attached to the vertical exposed surface of a window facing (FIG. 8A) or attached to the under surface of a window facing (FIG. 8B). From the illustration, it appears obvious as to how these approaches are facilitated.

Obviously, the fabric panel 12 could be similarly stored beneath the window, or in the case of windows, doors, or sliding glass doors, the fabric panel could possibly be attached on either side of the opening, then rolled and stored on one side or the other.

EXAMPLE 1

A flexible composite fabric was formed from a single ply fabric made of ultra high molecular weight, extended chain polyethylene fibers. The fibers were Spectra® 900, 650 denier yarn available from Honeywell International Inc. and had a tenacity of 30.5 g/d. The fabric was in the form of a plain weave woven fabric (style 904 made by Hexcel Reinforcements Corp.), characterized as having a weight of 6.3 oz/yd$^2$ (0.02 g/cm$^2$), 34×34 ends per inch (13.4×13.4 ends per cm), a yarn denier of 650 in both the warp and weft, and a thickness of 17 mils (425 μm). The fabric was laminated on both sides to a low density polyethylene film having a thickness of 1.5 mil (37.5 μm). A 4 mil (100 μm) film of ethylene vinyl acetate was used as a bonding layer between the fabric layer and the two polyethylene film layers. The layers were laminated together by a thermal lamination technique as described in U.S. Pat. Nos. 6,280,546 and 6,818,091.

The total composite fabric weight was 14.8 oz/yd$^2$ (0.05 g/cm$^2$), and the total composite fabric thickness was 0.030 inch (0.76 mm). The composite had a grab strength in the range of 850 to 950 pounds per inch (148.8 kN/m) of fabric width, as measured by ASTM 1682.

The percent transmitted light through this composite was found to be about 80% (test method based on ASTM D1746).

This fabric, when constructed into a storm panel as described above, effectively protects the underlying opening.

EXAMPLE 2

A flexible composite fabric was formed from a single ply fabric made of extended chain polyethylene fibers. The fibers were Spectra® 900, 1200 denier yarn available from Honeywell International Inc. and had a tenacity of 30 g/d. The fabric was in the form of a basket weave woven fabric (style 912 made by Hexcel Reinforcements Corp.), characterized as having a weight of 11.3 oz/yd$^2$ (0.044 g/cm$^2$), 34×34 ends per inch (13.4×13.4 ends per cm), a yarn denier of 1200 in both the warp and weft, and a thickness of 28 mils (700 μm). The fabric was laminated on both sides to a low density polyethylene film having a thickness of about 2 mils (10 μm). A 7-8 mil (175-200 μm) film of ethylene vinyl acetate was used as a bonding layer between the fabric and the two polyethylene film layers. The layers were laminated together by a thermal lamination technique as described in U.S. Pat. Nos. 6,280,546 and 6,818,091.

The total composite fabric weight was 20 oz/yd$^2$ (0.07 g/cm$^2$), and the total composite fabric thickness was 0.045 inch (1.14 mm). The composite had a grab strength in the range of 1700 to 1900 pounds per inch (298-333 kN/m) of fabric width, as measured by ASTM 1682.

This fabric, when constructed into a storm panel as described above, also effectively protects the underlying opening.

The foregoing description is illustrative of a preferred embodiment of the present invention, however it is apparent that various changes may be made without departing from the scope of the invention. For example, as described above, the system may be utilized with various types of building structures which would require various types of anchoring systems. The storm panel may be attached to the vertical surface of a building, the window or door facings, or the horizontal undersurface of an opening facing. There may be utilized the optional side openings which provide further reinforcement of the panel. Thus, various modifications and variations are possible. It is intended that the scope of the invention be limited not by the description of the preferred embodiments above, but rather by the following claims.

What is claimed is:

1. A storm panel for effectively protecting windows and doors in wall structures during high winds such as those accompanying hurricanes comprising:

(a) a woven panel of high strength translucent fabric formed primarily from yarns selected from the group consisting of yarns formed primarily of ultra high molecular weight polyethylene fibers, yarns formed primarily of ultra high molecular weight aramids, yarns formed primarily of ultra high molecular weight polypropylene fibers, and yarns formed primarily of blends thereof, said fabric having upper and lower edges and side edges and of such size and shape as to extend across the corresponding window or door;

(b) a fabric hem formed along at least the upper and lower edges of the panel;

(c) a relatively flat reinforcing bar formed of a material selected from the group consisting of metal and plastics and inserted in each hem and extending substantially the length of the hem;

(d) a series of holes at spaced points through each hem and reinforcing bar, a grommet surrounding each of the holes in the fabric layers and reinforcing bar; and (e) a plurality of anchors for installation through the holes and grommets in each hem and bar and into the adjacent wall structure;

(f) a low density polyethylene film laminated to at least one side of the fabric;

(g) the tenacity of the fibers in the yarns being ≧20 g/d and the denier of the yarns being in the range of 600-1200;

(h) the weight of the fabric being ≦20 oz/yd$^2$ and the weave of the fabric being selected from the group consisting of plain weave and basket weave; and (i) wherein the storm panel with its fabric, hem, reinforcing bar, and anchors being effective to pass the hurricane force wind requirements of the 2004 Florida Building Code and the 2003 International Building Code requirements for a large missile impact system.

2. The storm panel according to claim 1 and further including a decorative cover member formed of a fabric material attached along one edge adjacent the top of the fabric panel and having a length such as to substantially surround the panel when in a rolled up storage configuration, and a plurality of c-shaped clips attached at one end to the anchors and substantially surrounding the cover and rolled up panel, the clips maintaining the panel in the rolled condition in the storage configuration, wherein the cover provides an attractive protective cover for the storm panel in a storage configuration.

3. The storm panel according to claim 1 wherein the fabric panel further includes a series of holes with grommets along the side edges and anchors placed through the holes and grommets and into the underlying wall structure adjacent the sides of the window or door.

4. The storm panel according to claim 1 wherein the polyethylene film is bonded to the fabric by a layer of ethylene vinyl acetate.

5. The storm panel according to claim 4 wherein a layer of polyethylene film is bonded to both surfaces of the fabric, each by a layer of ethylene vinyl acetate.

* * * * *